US008987569B2

(12) United States Patent
Huber

(10) Patent No.: US 8,987,569 B2
(45) Date of Patent: Mar. 24, 2015

(54) TIP-WEIGHTED DRUMSTICK WITH RESILIENT, CUSHIONED HANDLE

(71) Applicant: James Huber, Schneider, IN (US)

(72) Inventor: James Huber, Schneider, IN (US)

( * ) Notice: Subject to any disclaimer, the term of this patent is extended or adjusted under 35 U.S.C. 154(b) by 0 days.

(21) Appl. No.: 14/072,666

(22) Filed: Nov. 5, 2013

(65) Prior Publication Data

US 2014/0123832 A1 May 8, 2014

Related U.S. Application Data

(60) Provisional application No. 61/722,265, filed on Nov. 5, 2012.

(51) Int. Cl.
*G10D 13/02* (2006.01)
*G10D 13/00* (2006.01)

(52) U.S. Cl.
CPC ..... *G10D 13/003* (2013.01)
USPC ..... 84/422.4

(58) Field of Classification Search
CPC ..... G10D 13/003
See application file for complete search history.

(56) References Cited

U.S. PATENT DOCUMENTS

| | | | | | |
|---|---|---|---|---|---|
| D152,877 | S | | 3/1949 | Geldard | |
| 2,659,605 | A | * | 11/1953 | Letourneau | 473/568 |
| 3,146,659 | A | * | 9/1964 | Robba et al. | 84/422.4 |
| 3,585,897 | A | * | 6/1971 | Stalcup | 84/422.4 |
| 3,608,419 | A | * | 9/1971 | Russell | 84/422.4 |
| 3,722,350 | A | * | 3/1973 | Cordes | 84/422.4 |
| 3,866,508 | A | * | 2/1975 | Huslig | 84/422.4 |
| 4,488,470 | A | * | 12/1984 | Larrain | 84/422.4 |
| 5,179,237 | A | | 1/1993 | Grossman | |
| 5,265,514 | A | * | 11/1993 | Schertz | 84/422.4 |
| 5,341,716 | A | * | 8/1994 | Donohoe | 84/422.4 |
| 5,447,088 | A | * | 9/1995 | Mester | 84/422.4 |
| 5,696,339 | A | * | 12/1997 | Brennan | 84/422.4 |
| 6,028,261 | A | * | 2/2000 | Johnson | 84/422.4 |
| 6,069,308 | A | * | 5/2000 | Rabb | 84/422.4 |
| 6,118,062 | A | | 9/2000 | Thoman | |
| 6,310,278 | B1 | * | 10/2001 | Butler | 84/422.4 |
| 6,326,535 | B1 | | 12/2001 | Pokallus | |
| 6,759,583 | B2 | | 7/2004 | Mizuno | |
| 7,173,176 | B2 | * | 2/2007 | Nybye | 84/422.4 |
| 7,439,435 | B1 | | 10/2008 | Jendrisak | |
| 2002/0002895 | A1 | * | 1/2002 | Zbrzezny et al. | 84/422.4 |
| 2006/0027073 | A1 | * | 2/2006 | Richard | 84/422.4 |
| 2008/0168890 | A1 | | 7/2008 | Judd | |
| 2008/0250911 | A1 | * | 10/2008 | Heselton | 84/422.4 |
| 2011/0247477 | A1 | | 10/2011 | Chang | |
| 2013/0298749 | A1 | | 11/2013 | Richards | |
| 2014/0123832 | A1 | * | 5/2014 | Huber, James | 84/422.4 |

* cited by examiner

*Primary Examiner* — Robert W Horn
(74) *Attorney, Agent, or Firm* — David J. Bremer

(57) ABSTRACT

A tip-weighted drumstick with a cushioned sleeve that absorbs shock and protects a drummer's hands and other joints while playing. The cushioned sleeve covers a reduced-diameter portion of the drumstick and can be customized with various surface textures, shapes, and other features. The reduced-diameter portion may result in the center of gravity of the drumstick shifting towards the striking end of the drumstick to improve the efficiency and effectiveness of the drumstick.

19 Claims, 3 Drawing Sheets

13
1A
1A
20
10
12
11

20
R
R'
14
13
15
14
30
12
11

TIP-WEIGHTED DRUMSTICK WITH RESILIENT, CUSHIONED HANDLE

The invention is a drumstick including a novel cushioned sleeve. The cushioned drumstick provides a comfortable grip plus improved tactility to facilitate fast stick-handling. The drumstick approximates the dimensions and shape of a conventional drumstick to minimize any learning curve necessary to adjust to the improved drumsticks. In some embodiments, in which material from the stick was replaced with resilient material, an unintended benefit was realized when it was discovered that the balance of the drumstick had changed and, in the opinion of some drummers, improved. It was recognized that the balance of the cushioned drumstick can be shifted by replacing more or less stick material with the resilient cushioned handle—effectively "dialing in" the balance according to a drummer's preference. Experimentation has shown that some drummers prefer a drumstick with the center of mass shifted forward towards the tip. An embodiment with a pre-determined, forward-shifted balance is expected to be welcomed by drummers.

The cushioned drumstick allows "new" drummers to learn how to play without being discouraged by sore hands that aren't used to holding and hitting with drumsticks. The cushioned drumstick allows "seasoned" drummers to play more years without discomfort or pain from the vibrations being transferred to their hands, wrists, and elbows. The stick also allows drummers to play for many hours in a day and do the same the following day while reducing soreness in their hands and arms.

The cushioned drumstick is compatible for use with various grip styles including the American, French, and German grips—both matched and traditional grip styles. The cushioned drumstick can also be implemented on drumsticks having various diameters, lengths, and styles, which is useful because drummers' stick preferences vary widely and the resilient, cushioned handle can be adapted across the wide variety of currently manufactured stick styles. Also, depending on the thickness and other properties of the resilient cushion material, as well as the relative inner and outer diameters of the sleeve and the shank, respectively, the sleeve will be either more or less stretched when mounted on the shank. This provides further customization possibilities, i.e., thinner and lighter sticks with heavy cushioning or light cushioning, with forward-shifted balance or not, etc.

DETAILED DESCRIPTION OF THE INVENTION

Figures 1, 1A, 2:
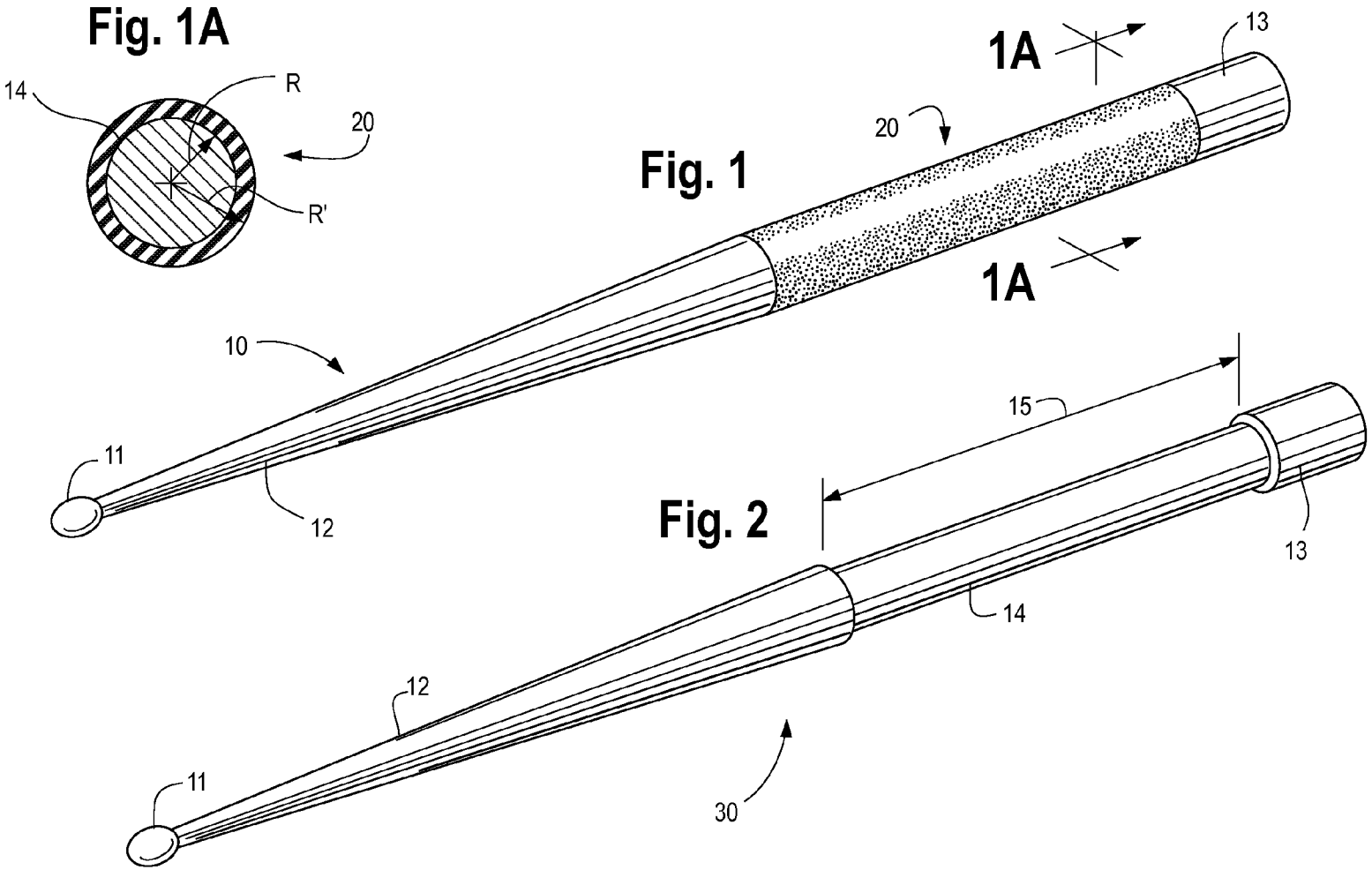
FIG. 1 is a perspective view of an embodiment of the invention.
FIG. 1A is a section view of an embodiment with a cushioned sleeve mounted on a reduced-diameter shank.
FIG. 2 is a perspective view of another embodiment, shown without the cushioned sleeve.

As shown in FIGS. 1 and 2, the cushioned drumstick is designed to look similar to a conventional drumstick. The cushioned drumstick 10 is based upon a trunk 30 that includes a tip 11, a shoulder 12, a butt 13, and a reduced-diameter shank 14 medial the butt 13 and the shoulder 12. The shank 14 has a shank length 15.

The sleeve 20 extends between the butt and the shoulder along the reduced-diameter shank 14. The sleeve 20 is separate from the remainder of the drumstick, and is generally removable and replaceable.

Figure 3:
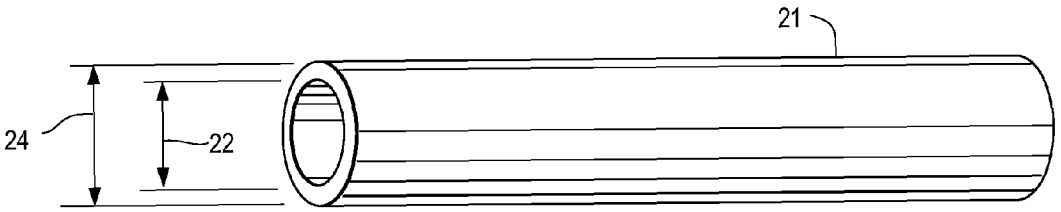
FIG. 3 is a perspective view of a one-piece cushioned sleeve.
Figure 4:
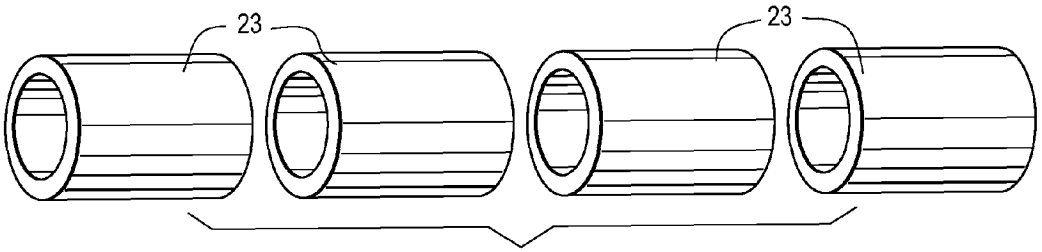
FIG. 4 is a perspective view of segments of a multi-piece cushioned sleeve.

The sleeve 20 may comprise a one-piece sleeve, for example, the sleeve 21 seen here in FIG. 3, which substantially extends over the shank length, seating between the shoulder 12 and the butt 13. Alternatively, the sleeve 20 may comprise a multi-piece sleeve that includes a plurality of sleeve segments 23 as shown in FIG. 4.

As used here and throughout, "substantially" is meant to encompass minor discontinuities and/or interruptions that may arise due to reasonable manufacturing and design tolerances.

The trunk 30 is preferentially a unitary construction although it may comprise an assembly of parts. The trunk may comprise various materials and combination thereof, including wood, plastic, and other synthetic and natural materials. Similarly, the parts of an assembled trunk may comprise a plurality of different materials, e.g., a wood butt and shank combined with a plastic tip, etc.

As seen in FIGS. 1, 1A, and 2, the novel shape of the trunk 30 provides a secure seat for the sleeve 20 (both one-piece and multi-piece) that maintains proper positioning of the sleeve during the strenuous activity of a drumming session. The reduced-diameter shank 14 includes a reduced diameter R. The butt 13 includes the larger diameter R1. The reduced-diameter shank 14 accommodates the additional thickness of the sleeve without significantly increasing the overall diameter of the drumstick. At the same time, the shoulder 12 and butt 13 capture the sleeve 20 on the shank 14 and impede the sleeve from creeping along the drumstick during play.

In one embodiment, the shank is produced by turning down the reduced-diameter on a lathe or other cutting instrument. The reduced-diameter may be controlled and varied to accommodate sleeves with different thickness (providing, for example, varying amounts of cushioning), and also to provide various final outer diameters according to the drummer's preference. The reduced-diameter shank may be easily and quickly incorporated into computerized numerical control (CNC) programs currently used to manufacture conventional drumsticks. The resulting updated programs can be introduced into the production cycle with little or no adverse affect on production cost or rate.

The resilient sleeve may be stretched, rolled, or otherwise positioned along the shank. Alternatively, a multi-piece sleeve may be mounted by positioning one segment at a time until the shank length is substantially covered by segments.

The resilient material of the sleeve 20 may be selected to provide various properties, such as durometer and adhesion, so that the sleeve is customizable to suit the individual preferences of a particular drummer. By manipulating the sleeve material properties, a drummer can "dial-in" the level of cushioning and tackiness of the cushioned drumstick. Alternatively, sleeves having different material properties may be provided at point of sale to enable a drummer to select his preferred sleeve from a plurality of prepared options.

A resilient material may be selected to provide a preferred amount of adhesion with the drummer's hands. When handling drumsticks during play, whether with dry or sweaty hands, there is effort put towards merely keeping the sticks in one's hands. The adhesive property of the resilient sleeve helps to provide a secure grip and allows the drummer to hold the sticks with much less effort. The "tackiness" feels like it is holding or gripping the drummer's hands.

Drummers may go to extreme lengths to protect their hands, wrists and elbows from damage resulting from the almost continuous impact on these body parts. Some drummers wear gloves made of different types of material or even wrap tape around their hands and fingers to help them hold on to their drumsticks and to absorb shock and vibration. Wrist wraps, supporting braces, and tendon compression bands, are just a few of the means utilized by drummers to minimize pain and extend their careers.

Similar aids are employed to improve the drummer's grip on their sticks. Special gloves similar to those used by athletes are also worn by some drummers. Others simply wrap their fingers and hands with adhesive tape. These measures help to ensure they don't drop or throw their sticks during a performance. The gloves (or tape) may possibly allow them to play for a longer duration. In spite of these potential benefits, many drummers, even after trying to play with gloves, choose not to wear them because the gloves seem to inhibit their control or "feel" of the drumsticks. With the "sticky" resilient sleeve and the vibration absorption provided by the resilient sleeve, the cushioned drumstick may eliminate the need for tape or gloves.

The sleeve design of the cushioned drumstick addresses both problems: improved grip and reduced impact, in a single elegant solution. The sleeve provides cushioning to absorb impact and vibration before it reaches the drummer's hands. Further, the tackiness of the sleeve material provides superior grip.

A specific sleeve design (shape and configuration) combined with a particular sleeve material may result in the cushioned drumstick substantially reproducing the weight and balance of a conventional drumstick. As such, the cushioned drumstick can be used almost interchangeably with conventional drumsticks, thereby minimizing any acclimation period or learning curve necessary when switching between the cushioned and the conventional drumsticks.

The resilient material may also be selected to obtain a particular balance for the drumstick. Sleeve material having a higher density will bias the stick balance towards the center of the sleeve, while lower density material will have less effect on balance.

The novel sleeve and trunk design enables drumstick balance to be altered and, in some ways, improved. By removing trunk material from the shank (to produce the reduced-diameter) and effectively replacing that material with an appropriate sleeve material, the weight and/or balance of the stick may be transferred to the top-half or striking end of the stick. This allows for a good, natural, comfortable feeling of "throwing" the stick. The hand placement may be the same as that of a conventional drumstick, but by throwing the stick, or the weight, the drummer can achieve the same sound and volume with much less effort. Sort of like hammers and baseball bats that are weighted to one end to produce a result with much less effort, the cushioned drumstick may reduce the effort and resulting fatigue of a long drumming session. An embodiment of the cushioned drumstick which is forward-balanced may find favor with many drummers, as it may improve the overall efficiency of a drummer's technique, i.e., require less effort to produce the same volume, absorb shock and vibration before they reach the hands, wrists, and arms, facilitate longer playing sessions and extend the working careers that might be curtailed due to injury.

The forward-balanced embodiments may be beneficial to those drummers who use the traditional grip, in which the two hands hold the sticks differently. One problem that may arise with the traditional grip is balancing the striking power (and therefore the volume of the respective strikes) between both hands. Typically, one hand is slightly disadvantaged due to the difference in grip, and this can become evident in the sound of the drummers play. The forward-balanced embodiments may minimize the advantage of the superior hand by allowing the inferior hand to work more efficiently.

Because the resilient sleeve is formed separately and then added to the trunk, it can be offered in different materials, colors and shapes, allowing the drummer to choose which one they prefer. A smooth outer surface, perhaps approximately the same diameter as the butt and shoulder, will offer both grip and cushioning characteristics to absorb the vibration and yet still be similar other wooden sticks. A ribbed handle may provide increased cushioning characteristic but also an additional amount of gripping surface. Alternatively, the ribs on the sleeve may be configured to match the angle of the fingers that are holding the stick. Ribs may extend circumferentially or longitudinally, or may be custom-designed to meet a particular drummer's preference.

Additionally, the modular and replaceable characteristics of the segmented sleeves enable a drummer to mix-and-match segments with different form factors, surface textures, and material properties to construct a custom drumstick tailored to individual preferences such as special contour arrangements, environment-specific, and even adapted to suit a particular music style. The drummer may select a ribbed-surface handle or a smooth handle depending on whether the performance is indoors (e.g., an air-conditioned studio) or outdoors (e.g., hot and humid). Various other sleeve characteristics can provide individual customization options. Sleeve segments can be switched on the same pair of sticks to accommodate varying playing environments.

Some of the textures and surface styles may include smooth, ribbed—both straight and diagonal, deep and shallow grooves, and spores. Particularly when using segmented sleeves, textures and styles may be mixed and matched on a single stick to provide the desired level of customization Playing style can be facilitated by a customized cushioned handle. For example, a drummer may choose a deep groove segment mounted mid-stick followed by ribbed segments as the combination best suited to spinning the sticks. Alternatively, grooved-segments may be stacked in either direction to provide specific finger locations. The axially-symmetric segments allow for equal comfort and performance for both right- and left-handed grips which may be more significant when using the traditional hand grip.

Figure 6:
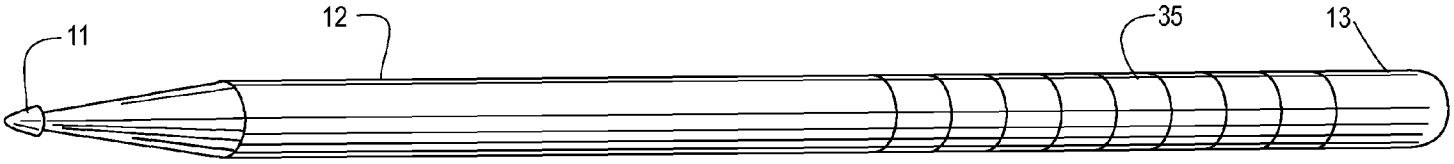
FIG. 6 is a perspective view of another embodiment of the invention.

FIG. 6 illustrates another embodiment of a segmented sleeve. The segments 35 in this embodiment are substantially smooth and may be preferred by some drummers.

Figure 7:
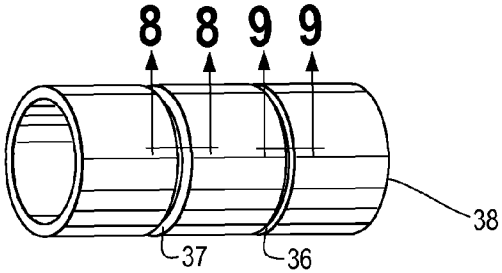
FIG. 7 is a perspective view of a sleeve segment with a deep groove and a shallow groove.
Figure 8:
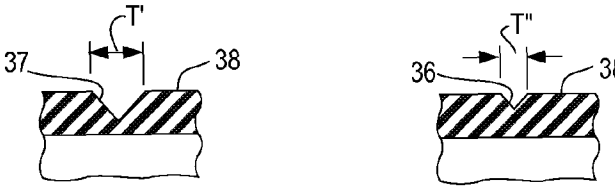
FIG. 8 is a section view of the deep groove of FIG. 7.
Figure 9:
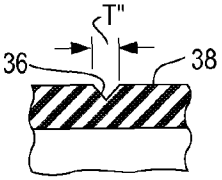
FIG. 9 is a section view of the shallow groove of FIG. 7.

FIGS. 7-9 illustrate an embodiment of a grooved segment 38 in which the segment includes both a deep groove 37 and a shallow groove 36 running circumferentially around the segment. FIG. 8 illustrates the deep groove 37 with a groove width of T'. FIG. 9 illustrates the shallow groove 36 with a smaller groove width of T". The large width of the deep groove 37 may provide a tactile indication of a drummer's preferred hand position by enabling the drummer to feel when his hand is in the correct position. Like other segments, the grooved segment 38 can be positioned along the stick by stacking various segments in both directions with the deep groove segment 38 in a preferred position in the stack.

Further customization possibilities can be achieved by mixing different colored segments, segments with various indicia, etc.

Some drummers may prefer a deeply grooved sleeve with significant circumferential peaks and valleys. Such an embodiment may provide a positive and repeatable grip location to ensure the drummer's feel of the stick is the same each time the stick is used. Alternatively, smaller grooves, combinations of patterns that vary depending on the sleeve region, or a substantially uniform surface texture (e.g., pebbled or spores) may be preferred. Any of these features, as well as other custom features and combinations thereof, may be integrated into the sleeve design.

Spinning drumsticks is often part of the drummer's performance, especially with marching bands. This technique is difficult to learn and even harder to master, but is made easier by the cushioned drumstick. With a conventional drumstick, dropping or accidentally throwing the drumsticks is very common, as is soreness of the fingers and knuckles from the stress of stick-handling. The adhesion of the resilient sleeve allows the drummer's hand to grip the drumstick when spinning and the cushioning effect of the sleeve relieves the discomfort in the fingers and knuckles. A sleeve design including deep grooves helps the drummer to isolate a balance point on the drumstick that facilitates rotating the drumstick in either hand between the index and middle fingers. When spinning the drumsticks between all four fingers, the stickiness of the sleeve helps the drummer spin the drumstick without dropping it.

Figure 5:
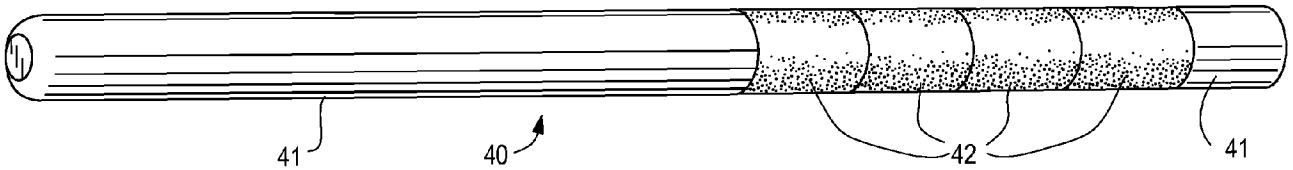
FIG. 5 is a perspective view of another embodiment of the invention.

FIG. 5 shows another embodiment of the cushioned handle drumstick. Some drummers prefer to use large diameter drumsticks that are the same on both ends 41 (sometimes called "double-butt end") and so don't have the traditional tapered shoulder and tip on one end. The double-butt end drumstick 40 is designed to produce a particular sound and increased volume, which may be the result of the heftier front-end contours of the double-butt end drumstick 40. The increased volume may be the result to the increased vibration when the heavy drumstick strikes the drumhead or cymbal. However, that increased vibration is also transferred through the drummer's hands and up his arms, and so the cushioned sleeve may provide an important comfort and health function on the double-butt end drumstick 40, also.

The novel sleeve/shank of the cushioned drumstick can be reproduced on this type of drumstick as well as on the above-mentioned conventionally tapered drumstick 10. Drummers using the double-butt end type of cushioned drumstick benefit greatly from the unbalanced drumstick producing more sound with less effort and also limiting the vibration transferred through the hand to the arm. The cushioned double-butt end drumstick can be offered in all of the presently available shapes and sizes with the addition of assorted colors and all drummers would benefit from their comfort, tackiness, unbalanced, and shock-absorbing characteristics throughout their playing careers.

The double-butt end drumstick 40 includes a segmented sleeve that comprises a combination of straight segments 42. Any of the different sleeve contours may be produced as individual segments and then arranged and configured to suit a drummer's particular preference. For example, a drummer may find that a single textured segment helps to locate a preferred balance point. By repositioning the segments to locate the single textured segment in various positions, the cushioned sleeve may provide an enhanced level of customization to each drummer.

The benefits of the cushioned drumstick are apparent when using the "matched" grip, in which the drumsticks are held the same way in both hands. The benefits are even more apparent when using the "traditional" grip of holding the drumsticks. With the matched grip, two hands hold the drumstick in the hand between the thumb and the index finger regardless of being right or left-handed. With the traditional grip, one drumstick is held in this manner and the opposite hand holds the drumstick between the thumb and index finger, and also between the middle and ring fingers. To strike a drum or cymbal the drumstick is "thrown" toward the ring finger, or more specifically at the knuckle of that finger. Many famous drummers who use this grip will also wrap their thumbs and fingers with tape before a performance and need to re-wrap the tape during the performance. The tape is needed because they are "heavy-hitters" and the tape allows them to hold on to the drumstick and also to protect their hands. Some drummers using the "matched" grip also tape their hands. The cushioned drumstick with properly modified balance will achieve the same volume with less effort, and the resilient sleeve may eliminate the need for a drummer to tape their hands to play the drums.

The forward-balance shift that occurs in certain embodiments of the cushioned drumstick may be adapted and customized to suit a drummer's preferences. A natural outgrowth of the manufacturing process in which a unitary drumstick is produced with a reduced-diameter shank, the forward-balance shift can be implemented in other embodiments that are manufactured in various ways.

By removing material (typically, but not always, wood) from the trunk, the balance point is inherently shifted towards the drumstick tip. The degree of forward-shift is controllable and may depend on several variables, including but not limited to the amount of diameter-reduction, the length of the reduced-diameter shank, and the distance from the butt end to the start of the shank.

The forward-shift is also responsive to the properties and characteristics of the cushioned sleeve. The weight of the sleeve may act to reduce the forward-balance shift, by replacing some of the weight removed when the trunk diameter is reduced. The weight of the sleeve may be modified by the choice of sleeve material, by the thickness of the sleeve, by the contour characteristics of the sleeve, as well as other properties of the sleeve.

All these variables, and others, can be utilized to produce cushioned drumsticks that are forward-balanced in a range of levels.

Forward-balanced drumsticks may be utilized by drummers to further enhance the cushioned drumsticks aforementioned advantages of cushioning and tackiness. When using forward-balanced drumsticks, the drummer may expend less energy and strike with less force while still achieving the same sound and volume qualities of a conventionally balanced drumstick. Further, reducing the force necessary to play may result in reduced wear and tear to the drummer's body. The forward-balanced embodiments therefore include another inventive, and unexpectedly effective, characteristic that provides novelty and utility over the current state of the art.

The invention claimed is:

1. A drum stick having a cushioned grip and forward-shifted center-of-gravity, the drum stick comprising:

a butt end having a first diameter;

an intermediate shank adjacent to the butt end, the intermediate shank having a reduced diameter abutting the first diameter that is smaller than the first diameter;

a shoulder portion adjacent to the intermediate shank, the shoulder portion having a second diameter abutting the reduced diameter, the shoulder portion terminating in a striking end distal the reduced diameter;

a resilient sleeve substantially covering the intermediate shank; and wherein the butt end, the intermediate shank, and the shoulder portion comprise parts of a continuous piece of material and are rotationally symmetric about a common axis, and wherein the reduced diameter is positioned on and extends along the common axis to cause a center-of-gravity of the drum stick to shift towards the striking end.

2. The drum stick of claim 1, wherein the resilient sleeve comprises a plurality of sleeve sections stacked along the common axis, each of the sleeve sections including a circumferential groove therein, wherein one of the circumferential grooves has a greater width to provide a tactilely detectable grip location.

3. The drum stick of claim 1, wherein the shoulder portion tapers down to a smaller diameter as the shoulder portion extends away from the intermediate shank.

4. The drum stick of claim 1, wherein the first and second diameters are the same diameter.

5. The drum stick of claim 1, wherein the second diameter extends to the striking end.

6. The drum stick of claim 1, wherein the resilient sleeve comprises a plurality of separate sleeve segments.

7. The drum stick of claim 1, wherein the resilient sleeve comprises at least one circumferential groove, the at least one groove having a groove depth and a groove width.

8. The drum stick of claim 1, wherein the resilient sleeve includes a pebbled exterior surface.

9. The drum stick of claim 1, wherein the resilient sleeves includes a series of circumferential peaks and valleys.

10. The drum stick of claim 1, wherein the resilient sleeve comprises a plurality of separate sleeve segments, and wherein at least one of the plurality varies in outer diameter along the common axis.

11. The drum stick of claim 1, wherein the resilient sleeve includes an adhesive outer surface.

12. A drum stick having a cushioned grip and forward-shifted center-of-gravity, the drum stick comprising:

a butt end having a first diameter;

an intermediate shank adjacent to the butt end, the intermediate shank having a reduced diameter abutting the first diameter that is smaller than the first diameter;

a shoulder portion adjacent to the intermediate shank, the shoulder portion having a second diameter abutting the reduced diameter, the shoulder portion tapering down to a smaller diameter distal the reduced diameter;

a resilient sleeve substantially covering the intermediate shank, wherein the resilient sleeve comprises a plurality of sleeve sections stacked along the common axis, each of the sleeve sections including a circumferential groove therein, wherein one of the circumferential grooves has a greater width to provide a tactilely detectable grip location; and wherein the butt end, the intermediate shank, and the shoulder portion comprise parts of a continuous piece of material and are rotationally symmetric about a common axis, and wherein the reduced diameter is positioned on and extends along the common axis to cause a center-of-gravity of the drum stick to shift towards the striking end.

13. The drum stick of claim 12, wherein the shoulder portion tapers down to a smaller diameter as the shoulder portion extends away from the intermediate shank.

14. The drum stick of claim 12, wherein the first and second diameters are the same diameter.

15. The drum stick of claim 12, wherein the second diameter extends to the striking end.

16. The drum stick of claim 12, wherein the resilient sleeve further includes a pebbled exterior surface.

17. The drum stick of claim 12, wherein the resilient sleeve further includes a series of circumferential peaks and valleys.

18. The drum stick of claim 12, wherein at least two of the plurality of separate sleeve segments have different outer diameters.

19. The drum stick of claim 12, wherein the resilient sleeve includes an adhesive outer surface.

* * * * *